United States Patent [19]

McKay

[11] 3,939,312

[45] Feb. 17, 1976

[54] PATTERN VOICE COIL TRANSDUCER HAVING PERMANENT MAGNET PLATES OF A SINGLE POLARITY

[76] Inventor: Norman J. McKay, 1670 Kilborn Ave., Apt. 17, Ottawa, K1H 6M9, Canada

[22] Filed: Mar. 12, 1974

[21] Appl. No.: 450,379

[30] Foreign Application Priority Data

Mar. 13, 1973 Canada ..... 166015

[52] U.S. Cl. ..... 179/115.5 PV

[51] Int. Cl.[2] ..... H04R 9/02

[58] Field of Search ..... 179/115.5 PV

[56] References Cited

UNITED STATES PATENTS

| | | | |
|---|---|---|---|
| 1,815,564 | 7/1931 | High | 179/115.5 R |
| 3,674,946 | 7/1972 | Winey | 179/115.5 PV |
| 3,832,499 | 8/1974 | Heil | 179/115.5 PV |

FOREIGN PATENTS OR APPLICATIONS

| | | | |
|---|---|---|---|
| 1,329,295 | 7/1961 | France | 179/115.5 PV |

*Primary Examiner*—Kathleen H. Claffy
*Assistant Examiner*—George G. Stellar
*Attorney, Agent, or Firm*—Cushman, Darby & Cushman

[57] ABSTRACT

An electromagnetic transducer in which a first set of magnetic poles confronts but is offset from a second set of magnetic poles across a space containing a diaphragm parallel to the planes containing the faces of the sets of poles. Conductors affixed to the diaphragm traverse the zones of flux between the two sets of poles and the current is so directed in the conductors that forces on them sum to move the diaphragm in the directions perpendicular to the planes of the pole faces. The magnetic poles may consist of magnetised ferrite material between which poles in each set ferrite material is absent. The ferrite material may be provided in sheets of plastic bonded ferrite material. A second transducer unit may be combined with the first to provide two or more diaphragms operating in cascade. Coupling between the diaphragm and the wave propagating environment or between the two diaphragms is effected through the spaces between the poles in the respective sets.

14 Claims, 11 Drawing Figures

PATTERN VOICE COIL TRANSDUCER HAVING PERMANENT MAGNET PLATES OF A SINGLE POLARITY

The present invention relates to the field of electromagnetic transducers and, in particular, relates to a planar electromagnetic transducer useful as a microphone or loudspeaker.

In the present application there is disclosed a new and improved form of electromagnetic transducer utilizing a permanent magnetic exciting field with conductors mounted on a diaphragm and positioned in the magnetic field so that electric current passing through the conductors causes motion of the diaphragm and the generation of acoustic waves which are the mechanical analogue of the electrical current flowing through the conductors. The reciprocal situation also applies in that motion caused in the diaphragm by incident acoustic waves will generate an analogue e.m.f. at the ends of the conductor.

Also disclosed in this application is an arrangement for providing a magnetic field adjacent to the conductor on the diaphragm which is intense, relatively uniform and which includes an assembly of permanently magnetic material, preferably, ferrite anisotropic and provided in a sheet, and magnetized on one face in a regular pattern of poles of one polarity. Such a sheet is spaced with one face a chosen small distance from the face of an equivalent similar sheet having poles of the opposite polarity with the diaphragm interposed between the two sheets. The sets of magnetic poles present on the confronting faces of these sheets are staggered from one another, magnetic material between the adjacent poles is preferably absent. The material may be of sheets which have been magnetized with a regularly alternating pattern of north and south poles and in which the unwanted alternate poles have been excised. The magnetic field leaving each set of single polarity poles passes diagonally across the space between the two sheets and intercepts conductors on the diaphragm. In one embodiment of the invention two diaphragm containing spaces are provided in a back-to-back arrangement so that movements in the diaphragms for a given input are in the same direction and increase the coupling efficiency to the environmental wave propagating medium. In another embodiment the two diaphragms are mounted in cascade by arranging three sheets or sets of ferrite material with one diaphragm in the space between the first and second sheet, and a second diaphragm in the space between the second and third sheet. Slots are pierced in the material between the wanted poles to allow acoustic coupling between the diaphragms and the environment and between the two diaphragms respectively. In following the teaching of the invention, transducers can be made with a wide range of electrical impedance, low self capacitance, low inductance and hence, constant electrical impedance. The pattern of the conductors on the diaphragm can be chosen to approximate any impedance or drive pattern desired of the diaphragm, the directivity of the device can be maniuplated by phasing the conductor arrays across the diaphragm and by alteration of conductor and drive current density. The arrangement may be made water immersible and can be assembled with accuracy. In accordance with yet another embodiment of the invention the diaphragm can be driven in such a way that it is always pushed by the conductors mounted on it, so that danger of tearing of the conductors from the diaphragm is substantially reduced.

More particularly in accordance with the invention there is provided electromechanical transducer apparatus which comprises, permanent magnet field generating means comprising a first assembly of permanently magnetic material displaying a pattern of magnetic poles solely of one polarity, a second assembly of permanently magnetic material spaced from the first assembly and displaying a second pattern corresponding to the first pattern of poles solely of opposite polarity to that of the first pattern, and means orienting said assemblies relatively to one another whereby a flux pattern is set up between the first and second patterns of poles across the space separating the two assemblies consisting of a pattern of similarly directed but alternately inclined field zones, an electrically insulating diaphragm in said space, conductors on said diaphragm, each conductor extending substantially across a respective field zone, and means connecting the ends of said conductors into a circuit in the sense that forces on said conductors reinforce in a chosen direction transverse to the diaphragm to move the diaphragm when current flow is in one direction in said circuit and forces on the conductors reinforce to move the diaphragm in the opposite direction when current flow in the circuit is in the opposite direction. The permanent magnetic is preferably ferrite anisotropic material and in sheets and with the ferrite material removed or absent between the material which forms the poles. The sheet material may consist of alternately magnetized material in which the alternate magnets have been excised from the sheet. It is preferable that the ferrite material be magnetized after working on it, but initially magnetized material can be used. Two or more diaphragms may be arranged in cascade by mounting a second permanent magnetic field generating means below the first, the two diaphragms being electrically coupled to be driven in the same direction simultaneously with acoustic coupling between the two diaphragms. The conductors may be subdivided so that the subdivisions may be electrically connected together to provide for a chosen electrical impedance for the unit.

Further advantages of the invention will be apparent from the description of specific embodiments which follows and where reference will be made to the accompanying drawings in which.

Figure 1:
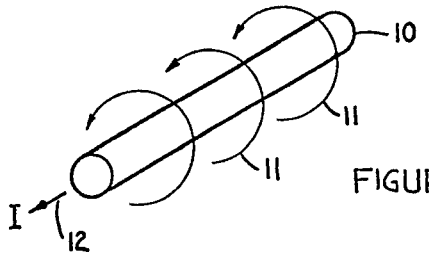
FIG. 1 is a simplified perspective view of an electrical conductor carrying current which induces an electric flux.

When an electric current passes through a long straight wire 10 as in FIG. 1, lines of magnetic flux are set up around the wire in the direction shown by the arrows 11, when the current I is flowing in the direction shown by the arrow 12.

Figure 2:
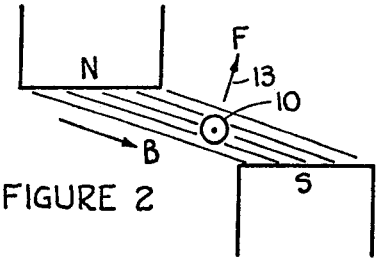
FIG. 2 illustrates the force and motion relationships involved in an electric conductor positioned in a magnetic field between a pair of opposite magnetic poles.

When, as in FIG. 2, a wire 10 carrying a current I out of the paper (positive charge flow convention) is introduced into a magnetic field B between two magnetic poles, a force F is exerted on the wire in the direction of the arrow 13, by the interaction of the current and the magnetic field. The force always tends to move the wire perpendicular to the lines of magnetic force.

Figure 3:
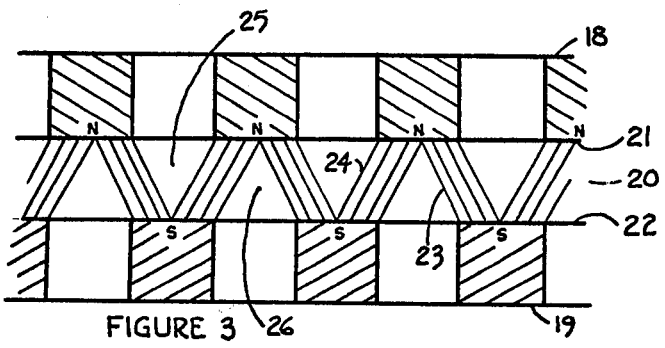
FIG. 3 illustrates a cross section through a pair of sheets of magnetic material and the field set up in the intervening space.

FIG. 3 illustrates an arrangement in which two rows 18 and 19 of magnets are arranged adjacent one another with a gap 20 between them. Assuming that the magnets extend for an appreciable distance above and below the plane of the paper, FIG. 3 represents a typical cross section. The flux pattern set up between the planes 21 and 22 of the faces of the rows 18 and 19 is represented by alternately inclined bunches of lines of force 23 and 24 between which exist areas of low field strength 25 and 26. If now a conductor is placed in the field represented by 23 and current is caused to flow as described for FIG. 2 an upwardly inclined force to the right will be exerted on that conductor. If a second conductor is placed in the field represented by 24 but with the current reversed to that in the first conductor there will be a force exerted on that conductor upwards and to the left. If the conductors are coupled together mechanically, the vectors representing the forces exerted on these two conductors will cancel in a direction parallel to the planes 21 and 22, but will reinforce in the perpendicular upward direction. Reversal of the currents will exert a resultant downward force on the conductors.

Figure 4:
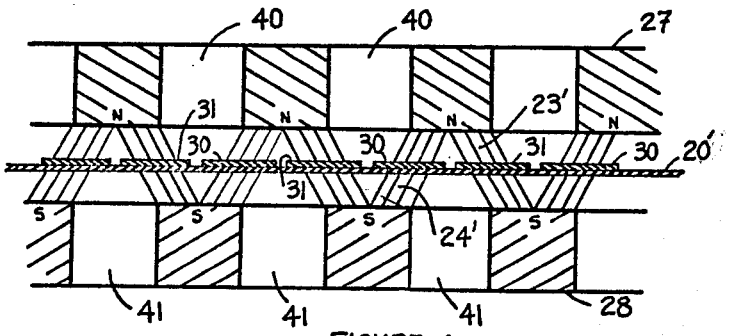
FIG. 4 illustrates the arrangement of FIG. 3 with a diaphragm and mounted conductors in the intervening space.

In FIG. 4 there is shown two sheets of ferrite material 27 and 28 between which is a diaphragm 20' and attached to which are a series of conductor strips 30 and 31, current being arranged to flow in the same direction with respect to the plane of the paper for the groups of conductors 30 and 31 respectively, but the current in conductors 31 being opposite in direction to that in conductors 30. The conductor strips are of sufficient width they will at all times intercept essentially all of the magnetic flux passing through their respective zones 23' and 24' while still allowing for upwards and downwards excursions. The diaphragm provides mechanical coupling between the conductors and allows only up and down motion since the forces will reinforce in these directions and cancel in the plane of the diaphragm. The operation will be substantially linear, the force exerted on each conductor being proportional to the current in that conductor. The diaphragm 20' is coupled to the environment by penetrating the sheets 27 and 28 between the magnet areas at 40 and 41.

The structures of the sets of poles 18 and 19 or sheets 27 and 28 illustrated in FIGS. 3 and 4 can make use of a material sold by the Dielectric Materials and Systems Division of 3M Company under the trade mark PLASTIFORM. PLASTIFORM magnetic sheet is available in two types, PLASTIFORM 1 and PLASTIFORM 1H, the second having the higher coercive force, and consists of a rubber bonded anisotropic barium ferrite powder. One form is magnetized in alternating parallel north and south polar strips running across its width typically at 8 poles per inch. If, therefore, a pair of such sheets is oriented as shown in FIG. 4, and the material carrying the second sets of alternate magnets at 40 and 41 respectively is removed, the desired field pattern and coupling to the environment can be achieved simultaneously. Absence of the ferrite material at 40 and 41 serves to prevent self-demagnetisation and short circuiting of the flux path between the magnets on the respective sheets. PLASTIFORM material is also available in self-adhesive form and as unmagnetized sheets or in sheets with the whole of one face of a chosen magnetic polarity. With the unmagnetised sheets which is preferred magnetisation must be carried out after working on the sheets. Such post-magnetisation avoids the problem of incorrect magnetisation of the finished product due to encountering stray magnetising fields during processing. When the sheets 18 and 19 are first rigidly mounted on a backing it is possible to remove essentially all of the material corresponding to the strips 40 and 41, but otherwise it is practical and satisfactory to remove up to 90 percent of the material with a remainder of 10 percent for mechanical bridging purposes to ensure continued orientation of the remaining magnets.

In practice the diaphragm may be made of a suitable synthetic material, polyethylene being particularly cheap and satisfactory, but polyesters, for instance that sold under the trade mark MYLAR, or vinyl chloride polymer derivative such as that sold under the trade mark SARAN are also very useful. Preferably too the diaphragm is made of a heat shrinkable material so that when mounted in a suitable rigid mechanical frame some control can be exercised over the tension in the diaphragm.

Figure 5:
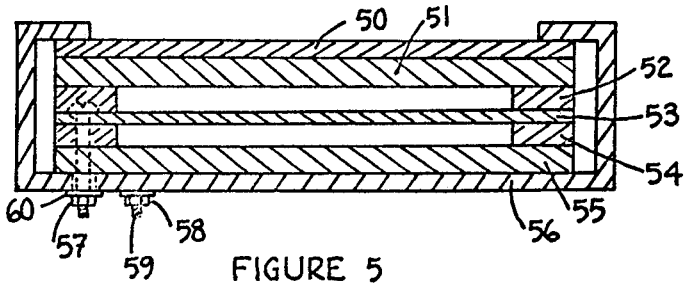
FIG. 5 illustrates a transducer construction embodying the invention.

A typical practical assembly is shown in FIG. 5 consisting of a rigid upper plate 50 of permeable ferrite material such as mild steel upon which is mounted a sheet of PLASTIFORM material 51, a peripheral gasket 52, diaphragm 53 mounted on a second gasket 54, a second sheet of PLASTIFORM material 55 and a base cup shaped support 56 of magnetically permeable material. The plate 50 and cup 56 complete the magnetic circuit between the magnets in sheets 51 and 55. Terminals 57 and 58 connect to the conductors on the diaphragm via bolts 59 through insulated bushings 60 in cup 56 and through sheet 55 and gasket 54.

Figure 6:
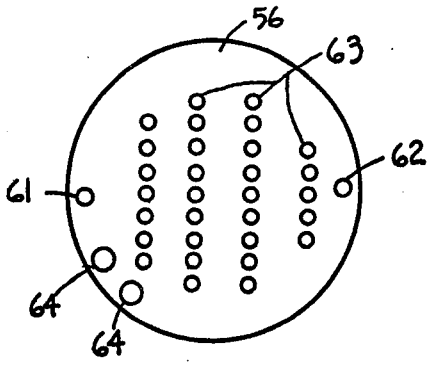
FIG. 6 is a plan view of one of the components of FIG. 5.

The sheets 51 and 55 are adhered respectively to their supports 50 and 56 (support 56 is illustrated in FIG. 6) so oriented that the magnetic pattern on the sheets 51 and 55 bears a chosen relationship to known index points on the mounts such as locating stud holes illustrated at 61 and 62. The plates are pierced in a pattern of holes 63 aligned with the strips 40 or 41 (see FIG. 4) which are to be removed. The material is removed in strips adjacent to the holes 63 from the sheets 51 and 55 once they are properly oriented and adhered to their supports 50 and 56. Holes 64 in support 56 receive the terminal bushings 60. Similar holes to locating holes 61 and 62 may be made in the gasket 52 and 54 (properly related to the conductor pattern on the diaphragm which has been affixed to and if desired heat shrunk on its gasket) so that the assembly may be put together accurately and glued with a suitable permanent adhesive around the entire periphery of support 50, sheet 51, gasket 52, diaphragm 53 and gasket 54, sheet 55 and support 56. Finally, the magnetic circuit is closed by spinning the upper rim 59 of cup-shaped support 56 over the edge of plate 50. While the device would be operative without the permeable material 50 and 56 to complete the magnetic circuit through the ferrite 51 and 55, since the stray field would do this, it is preferable that positive means be adopted for the completion to ensure a higher field in the diaphragm zone and less tendency to self-demagnetisation. The indexing and orienting of the means for making holes 63 and removing slotting or punching out the magnetic material where required from sheets 51 and 55 will not be detailed here.

Figure 7:
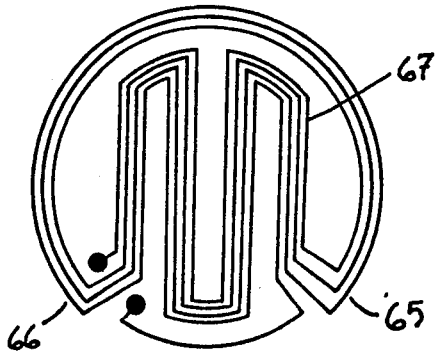
FIG. 7 is a plan view of another typical component of FIG. 5.

FIG. 7 shows one form which the conductor pattern may take on the diaphragm. In this instance the pattern consists of four parallel sets of paths of sub-conductors 67, each set of paths corresponding to a single conductor 30 and 31 of FIG. 4. The arrangement of FIG. 7 produces an impedance four times that which would be obtained if the four parallel paths (electrically in series at 65 and 66) were combined into a single path. Other combinations of paths are clearly possible, determined by the size of the transducer and the impedance desired at the terminals. Sets of paths may be connected electrically in parallel or series as may be necessary.

Figure 8:
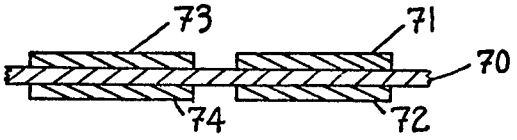
FIG. 8 is a cross section through a diaphragm designed for push-push operation.

A particularly useful development of diaphragm structure is shown in FIG. 8 where the diaphragm 70 has twin pairs of conductors 71 and 72 and 73 and 74 alternating across the diaphragm. By electrically driving these conductors alternately on one side and the other of the diaphragm so that they exert force towards the diaphragm only, a push-push effect on the diaphragm is possible. This is desirable where high forces may be involved such as where the transducer may be operated in a liquid and tight coupling between the diaphragm and the wave propagating medium is involved. Structures in accordance with the invention are suitable for immersion in liquids, particularly water, since they can be entirely water inert and find applications in ultrasonics, sonar, and underwater communication, etc.

The directivity of the sound provided by units made in accordance with the invention or the microphonic directive properties can be varied by phasing the drive or pick up of the conductor array on the diaphragm. The size of the unit is for all practical purposes unlimited, and the pattern of conductors on the diaphragm can be chosen to suit the directive properties required.

Because alternate conductors carry current travelling in opposite directions, the distributed self-capacity is low. The net inductance of the conductors is also low since the fields produced by adjacent conductors are not additive for the same reason.

If desired, the magnetic field for the conductors can be produced by castings of ferrite material preferably anisotropic in which the easy axis of magnetization is perpendicular to the plane of the diaphragm. The pattern placed on such material can be chosen at will and material is absent between the areas for the desired poles. It will also be appreciated that if the ferrite or PLASTIFORM material is obtained without initial magnetization or alternatively if it is demagnetized by first cycling it in a high flux alternating field of diminishing intensity it may be remagnetized in any desired pattern. The choice of the hole pattern to be made in the ferite material is thus much wider than working with premagnetised material. Since the material is anisotropic the lines of force emanate from the surface of the material in the perpendicular direction and essentially all the field produced by the elemental magnets in the ferrite material is made available in the space beyond the surface of the materials. As mentioned before, it is desirable that the ferrite material be magnetised after working to avoid accidental demagnetisation during processing. It is not necessary that the magnetic material be provided in sheets although this is preferred the assemblies may consist of sets of discrete bar magnets laid out as in FIG. 3, and adhered to a suitable support. The cross section of the magnets is not critical and they may for instance be rectangular, circular, truncated, elliptical, etc. dependent upon the detailed field pattern one wishes to establish to achieve desired linear or other performance with a chosen conductor shape.

Figure 10:
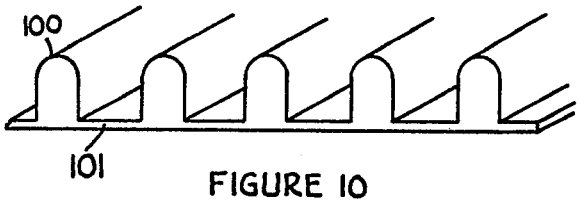
FIGS. 10 and 11 are two perspective views of some alternate shapes which the ferrite material may take.
Figure 11:
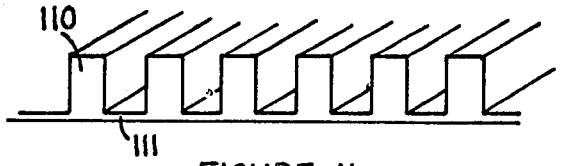

Alternatively, the material forming the sets of magnets apart from that hitherto described may take the form of extrusions where a variety of different pole shapes may be obtained. Examples are shown in FIGS. 10 and 11. The web of material 101 and 111 respectively being thin has an insignificant magnetic function but serves positively to locate the magnet portions 100 and 110. Holes for acoustic coupling are pierced in the webs as required.

Figure 9:
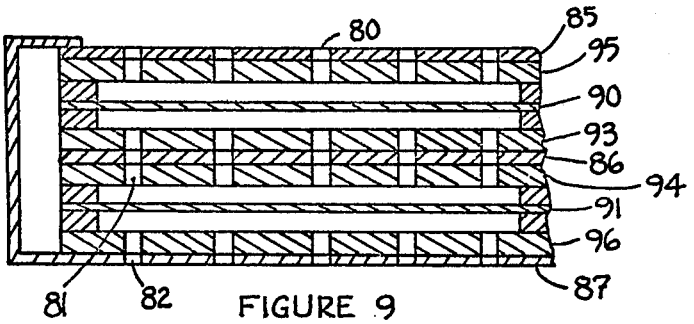
FIG. 9 is a cross sectional view of an embodiment of the invention with cascaded diaphragms.

If a pair of transducers are arranged back-to-back or in a structure such as shown in FIG. 9, the diaphragms can be driven in phase with one another and the coupling to the environmental wave propagating medium correspondingly increased as shown by the theory. The arrangement of FIG. 9 is in partly exploded and broken view for the sake of clarity, and only some of the perforations 80, 81 and 82 in the upper support plate 85, the middle support plate 86 and the lower support plate 87 respectively are depicted. It will be clear that if the central plate 86 is replaced by a rigid permanent magnet ferrite sheet then this single central sheet can provide the magnetic poles for the upper and lower diaphragms 90 and 91 respectively so that the duplicate ferrite sheets 93 and 94 may be eliminated. Upper and lower sheets 95 and 96 may be replaced by rigid permanent magnet ferrite also.

Additional embodiments can include further cascaded diaphragms by mounting additional basic units on and above, or below the device of FIG. 9.

The embodiments of the invention in which an exclusive property or privelege is claimed are defined as follows:

1. Electromechanical transducer apparatus which comprises, permanent magnet field generating means comprising a first assembly of permanently magnetic material displaying a sole pattern of magnetic poles solely of one polarity, a second assembly of permanently magnetic material spaced from the first assembly and displaying a second sole pattern corresponding to the first pattern of poles solely of opposite polarity to that of the first pattern, and means orienting said assemblies relatively to one another whereby a flux pattern is set up between the first and second patterns of poles across the space separating the two assemblies consisting of a pattern of similarly directed but alternately inclined field zones, said assemblies each comprising a sheet of ferrite material each displaying the respective magnetic pole pattern on one face thereof, an electrically insulating diaphragm in said space, conductors on said diaphragm, each conductor extending substantially across a respective field zone, and means connecting the ends of said conductors into a circuit in the sense that forces on said conductors reinforce in a chosen direction transverse to the diaphragm to move the diaphragm when current flow is in one direction in said circuit, and forces on the conductors reinforce to move the diaphragm in the opposite direction when current flow in the circuit is in the opposite direction.

2. Apparatus as defined in claim 1, said diaphragm being of heat shrinkable material.

3. Apparatus as defined in claim 1, each conductor being sub-divided into at least two sub-conductors insulated from one another.

4. Apparatus as defined in claim 1 the sheets being formed as sets of magnets having thin web portions between the magnets.

5. Apparatus as defined in claim 1, said diaphragm comprising polyethylene, Mylar or Saran.

6. Apparatus as defined in claim 1, said sheets comprising alternately magnetized plastic bonded ferrite material, alternate magnets in said sheets having been substantially removed each to provide a sheet having magnetic poles of the chosen polarity.

7. Apparatus as defined in claim 1, comprising magnetically permeable means for closing the magnetic flux path through said field zones.

8. Apparatus as defined in claim 1, said ferrite material being anisotropic with its easy axis of magnetisation perpendicular to the sheet.

9. Apparatus as defined in claim 8 said anisotropic material being absent between the material forming said poles.

10. Apparatus as defined in claim 1, comprising holes formed in said ferrite sheets for coupling of the diaphragm with a wave propagation environment.

11. Apparatus as defined in claim 10, said permanently magnetic material being post-magnetised to produce the said patterns.

12. Apparatus as defined in claim 1, comprising, a second said diaphragm, second permanent magnet field generating means for said second diaphragm, said second permanent magnetic field generating means comprising a third assembly of permanent magnetic material displaying a sole third pattern of magnetic poles of said opposite polarity, said second assembly of permanently magnetic material also displaying on a face a sole fourth pattern corresponding to the third pattern of poles of the first polarity, and means orienting said third assembly with respect to said second assembly and spaced therefrom for setting up a flux pattern between the second and the third assemblies across the space separating them consisting of a further pattern of similarly directed but alternately inclined field zones, conductors on said second diaphragm each extending substantially across a respective field zone, means connecting the ends of said conductors on the second diaphragm in a second circuit in the sense so that forces on said conductors reinforce in a chosen direction transverse to the second diaphragm to move the second diaphragm when current flow is in one direction in said second circuit, and means connecting said first and second circuits so that current flow simultaneously produces movement of said first and second diaphragms in the same direction.

13. Apparatus as defined in claim 12 said assemblies each comprising a sheet of anisotropic ferrite material each displaying the respective magnetic pole patterns on respective faces thereof.

14. Apparatus as defined in claim 13, said sheets comprising alternately magnetized ferrite sheet material alternate poles having been excised from said sheets.

* * * * *